US005325101A

United States Patent [19]

Rudish et al.

[11] Patent Number: 5,325,101

[45] Date of Patent: Jun. 28, 1994

[54] CYLINDRICAL PHASED ARRAY ANTENNA SYSTEM TO PRODCE WIDE OPEN COVERAGE OF A WIDE ANGULAR SECTOR WITH HIGH DIRECTIVE GAIN AND WIDE FREQUENCY BANDWIDTH

[75] Inventors: Ronald M. Rudish, Commack; Scott F. Hall, Plainview, both of N.Y.

[73] Assignee: Eaton Corporation, Cleveland, Ohio

[21] Appl. No.: 11,051

[22] Filed: Dec. 29, 1986

[51] Int. Cl.[5] ..... H01Q 3/22; H01Q 3/24; H01Q 3/26

[52] U.S. Cl. ..... 342/373; 342/372; 342/375

[58] Field of Search ..... 342/372, 373, 375

[56] References Cited

U.S. PATENT DOCUMENTS 4,316,192 2/1982 Acoraci ..... 342/373

*Primary Examiner*—Theodore M. Blum

*Attorney, Agent, or Firm*—Oldham, Oldham & Wilson Co.

[57] ABSTRACT

A cylindrical phased array antenna system capable of scanning at rates faster than the information rate of signals being received so that no information is lost by the scanning process, and without sensitivity loss due to sampling and with reduced frequency selectivity. The cylindrical phased array is comprised of the means to decompose the distribution of current on the radiator elements caused by wave incidence into component signals which are the Fourier spatial harmonics of the distribution, heterodyne means to differentially phase shift these component signals at rates exceeding 4 radians per cycle of the highest frequency present in the information content of the incident wave, and means to form multiple complex-weighted sums of the component signals. The sums are multiple time sequenced responses, each response corresponding to a different beam of sensitivity. The beam responses from any particular incident signal to be differentially delayed to occur in unison, and then noncoherently added, giving rise to a compressed pulse whose time of occurrence is related to the signal angle of incidence.

4 Claims, 2 Drawing Sheets

CYLINDRICAL PHASED ARRAY ANTENNA SYSTEM TO PRODCE WIDE OPEN COVERAGE OF A WIDE ANGULAR SECTOR WITH HIGH DIRECTIVE GAIN AND WIDE FREQUENCY BANDWIDTH

TECHNICAL FIELD

This invention relates to cylindrical electronically scanned antenna systems which scan at rates faster than the information rate of the signals being processed and more particularly to improvements in the signal combining subsystem of such systems to simultaneously achieve wide frequency bandwidth and high values of gain by eliminating sampling loss.

BACKGROUND ART

It is sometimes desirable to configure a system to receive all of the electro magnetic signals within a receiver's capability as limited by its sensitivity and bandwidth. Signals of interest are usually incident from widely diverse directions. Therefore, the prior art methods have utilized antennas having a wide azimuth beam width, such as an omnidirectional antenna, as the system's receptor element.

A severe limitation of this approach is that it does not permit directional resolution of multiple signals. Such resolution is usually desirable to prevent garbling of signals that cannot otherwise be resolved in frequency or time-of-occurrence. Directional resolution is also desirable in cases where the direction of incidence of the signals is to be estimated.

To overcome these disadvantages, alternative prior art systems have been configured using narrow-beam antennas. In one case, multiple antennas, each producing a narrow beam, are arranged in a circular pattern so that their beams are contiguous and point radially outward. In another case, a single cylindrical array antenna is configured to form multiple beams which are contiguous and point radially outward. In both cases, each beam port of the antenna(s) is connected to a separate receiver, thus the system can exhibit the advantages of both good directional resolution and complete, simultaneous directional coverage. However, the disadvantage in this case is the high cost of the multiple receivers.

Another class of prior art systems attempts to achieve omnidirectional coverage with a single narrow beam by scanning that beam as a function of time. In these systems, a narrow-beam is scanned over all azimuths by mechanical rotation of a fixed-beam antenna, or by electronic scan of a cylindrical array antenna. The disadvantage in this case is that the beam cannot look everywhere at once. This is especially a problem for multiple signals from diverse directions if they are nonrepetitive in character or have rapidly changing wave forms (high information rate or short-pulse signals). These high information rate signals may not be sampled at sufficient rate by the scanning beam to prevent information loss.

More recently, techniques have been disclosed which address the problems associated with directional resolution of multiple signals. A pending patent application, U.S. Ser. No. 719,460, teaches a cylindrical array antenna system capable of scanning through its complete coverage sector at a rate at least twice as fast as the maximum information rate of the signals it receives so that no information is lost. This allows the antenna to scan within the time period of the shortest pulse which it is expected to receive and thereby have a high probability of intercepting that signal. This system provides angular resolution of multiple signals and the capabilities of determining their direction of arrival commensurate with the narrow beamwidths of a full N element cylindrical array. The system provides the same sensitivity and resolution regardless of the direction of signal incidence. These improvements were the result of using heterodyne techniques to achieve very rapid scanning of a single beam throughout the antennas' entire sector of coverage.

This technique, however, results in a sampling loss which is solved by the instant invention.

DISCLOSURE OF INVENTION

This invention consists of a cylindrical phased array antenna system capable of scanning at rates faster than the information rate of signals being received so that no information is lost by the scanning process. The array is configured to eliminate the sensitivity loss due to sampling (see U.S. patent application Ser. No. 719,460), the frequency selectivity (see U.S. patent application Ser. No. 807,871), and the complexity of multiple outputs (see U.S. patent application Ser. No. 899,629), encountered with prior art recent inventions. The cylindrical phased array is comprised of the means to decompose the distribution of current on the radiator elements caused by wave incidence into component signals which are the Fourier spatial harmonics of the distribution, heterodyne means to differentially phase shift these component signals at rates exceeding $4\pi$ radians per cycle of the highest frequency present in the information content of the incident wave, and means to form multiple complex-weighted sums of the component signals. The sums are multiple time sequenced responses, each response corresponding to a different beam of sensitivity. The beams together with each other form a contiguous set that both fill all azimuths at any one time and also synchronously scan all azimuths. The beams are differentially delayed to permit the beam responses from any particular incident signal to be added in unison, giving rise to a compressed pulse whose time of occurrence is related to the signal angle-of-incidence. Envelope detection is done prior to beam addition to ensure that the addition process is not restrictive of frequency bandwidth. In effect, the new invention retains the angle independent wide-open reception characteristics of an omni antenna, while exhibiting the gain and angular resolution of a multi-element phased array antenna.

BEST MODE FOR CARRYING OUT THE INVENTION

Figure 1:
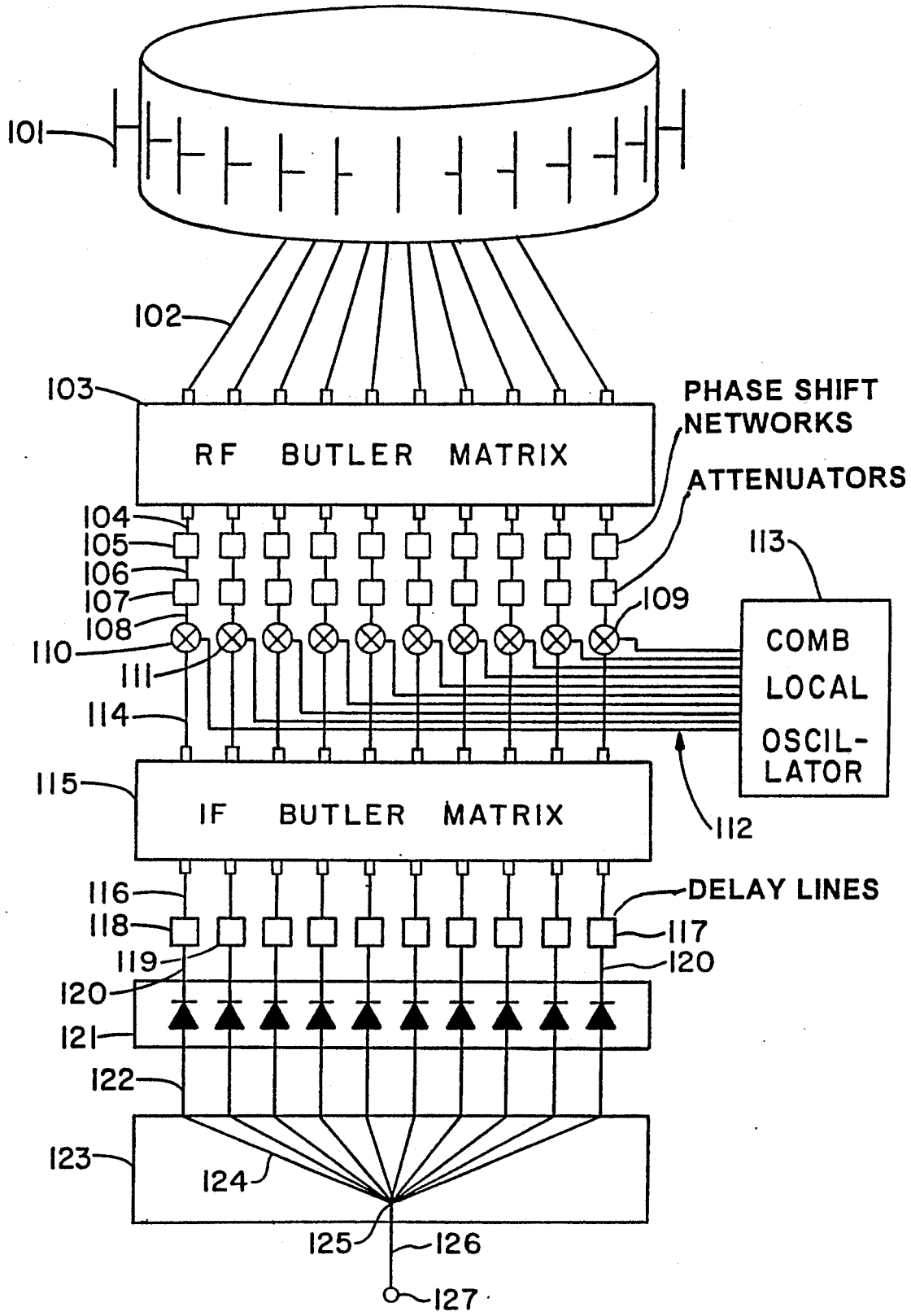
FIG. 1 is a block diagram of the overall system of the present invention which solves the sampling loss and frequency selectivity problems of the prior art.

The diagram of FIG. 1 comprises a cylindrical array of N antenna elements 101, N equal length transmission lines 102 which connect elements 101 with N input ports of RF Butler Matrix 103. N equal length transmission lines 104 connect N output ports of Butler Matrix 103 to a set of N fixed phase shift/delay networks 105 for focus, which in turn are connected by N equal length cables 106 to a set of N attenuators 107 which provide differential amplitude weights. N equal length transmission lines 108 connect the outputs of attenuators 107 to inputs of a set of N mixers 109 with end mixer 110 and adjacent mixer 111. N equal length transmission lines 112 connect mixers 109 with a comb local oscillator 113. The output ports of mixers 109 are connected by N equal length transmission lines 114 to IF Butler Matrix 115. The N outputs of Butler Matrix 115 are connected by N equal length transmission lines 116 to a set of N fixed delay lines of progressively differing length 117 with end delay line 118 and adjacent delay line 119. A set of N equal length transmission lines 120 connect the fixed delay lines 117 to a set of N envelope detectors 121. The outputs of the envelope detectors 121 are connected by a set of approximately equal length transmission lines 122 to a signal combiner 123. Signal combiner 123 consists of N equal length transmission lines 124 which join together at summing junction 125. Transmission line 126 connects summing junction 125 to a single output port 127.

For purposes of illustrating the operation of FIG. 1, assume that a pulsed signal wave front is incident from the direction $\phi=O$ (reference direction). This induces RF signals in the antenna elements 102 and these are divided and recombined N different ways by the Butler Matrix 103. These N recombined signals appear at the output of the Butler Matrix and are applied to the fixed phase shifters 105. These signals represent the N+1 circular modes (the $-N/2$ and $+N/2$ mode are identical and are output at the same Butler Matrix port) discussed in connection with the prior art system of Ser. No. 719,460. The fixed phase shift networks 105 are used to set all of the outputs of RF Butler matrix 103 to an in-phase condition for the case where a signal is incident to the antenna from a reference direction. For the case where a signal is incident from a direction making an angle $\phi$ relative to the reference direction, the outputs of the phase shift networks 105 will be a set of signals having a relative phase delay that increases progressively (and linearly) with position along the bank of phase shifters. As discussed in connection with the prior art system of Ser. No. 719,460, the value of progressive phase retardation is $\phi$ radians per position. The outputs of the fixed phase shifters are fed into the RF inputs of the set of N mixers 109. Also applied to mixers 109 by comb local oscillator 113 are a set of coherently-related CW signals which differ from each other in frequency by integer multiples of a constant frequency offset. At the instant of time t=o and periodically once every cycle of the offset frequency thereafter, all the local oscillator (LO) signals peak simultaneously and are effectively in phase in those instants. Thus, at these instances, the LO and mixers do not impart any relative phase difference to the IF signals at the outputs of the mixers so that these IF signals have the same effective phase relationship as the RF signals. At other instants of time, the LO and mixers will impart a phase advance to the IF signals that progressively (and linearly) grows larger with both time and position along the bank of mixers. These IF signals are then fed into the input ports of the IF butler Matrix 115. The properties of this device are such that a set of signals applied to its input terminal set will all coherently sum to the Mth output port if the input signals are uniform in amplitude and have a linear progressive phase with adjacent input ports differing in phase by the amount $(2M-1)\pi/N$. The different outputs of the Butler matrix 115 correspond to different beams of the antenna. These beams are contiguous and, taken together, completely cover all azimuths. In addition, these beams rotate in azimuth, while maintaining their positions relative to each other; they rotate at such a speed that each beam covers all azimuths within the period of one cycle of the LO offset frequency. This scanning action of the beams causes the signals output by Butler matrix 115 to have pulse-modulated envelopes, with the width of the modulation pulse corresponding to the time each beam contains a signal incidence direction. The outputs of the Butler Matrix 115 are fed into delay lines 117. Adjacent delay lines have an increasing amount of delay and serve to align the pulse envelopes of the different IF signals which are output from the Butler Matrix 115 so that they all peak at the same time as the latest output. After alignment of the envelopes by the delay lines, the signals are applied to envelope detectors 121. The envelope detectors effectively strip the carriers and provide output voltages which are proportional to the envelope of the input IF signals. The output of the individual envelope detectors are then summed together at the summing junction 125, within signal combiner 123. The resulting output is a signal which peaks in time at a time depending upon the angle of incidence of an incoming signal.

With reference to the above description of operation, it is possible to explain how the instant invention overcomes the aforementioned deficiencies of the prior art. It may have been noted that each beam, represented by an output of Butler matrix 115, receives only a sample of the incident signal as the beam rotates, as in the case of the prior art (patent application Ser. No. 719,460), however, the sum of all the beams, represented by the signal at output port 127, receives all the signal, effectively eliminating (within the limitations imposed by noncoherent addition) the sampling loss deficiency of the prior art. Also, it may have been noted that the delay lines 117 add frequency dependent phase shift to the signals, as in the case of prior art (patent application Ser. No. 807,871). However, stripping the carrier before the beam summing operation removes the dependency of the summed result on the phase of each constituent signal, effectively eliminating the frequency selectivity deficiency of the prior art. Finally, the instant invention, with only a single output port 127 obviously overcomes the deficiency represented by prior art approaches (patent application Ser. No. 899,629) which require the complexity of multiple outputs to solve the frequency selectivity and sampling loss deficiencies.

Figure 2:
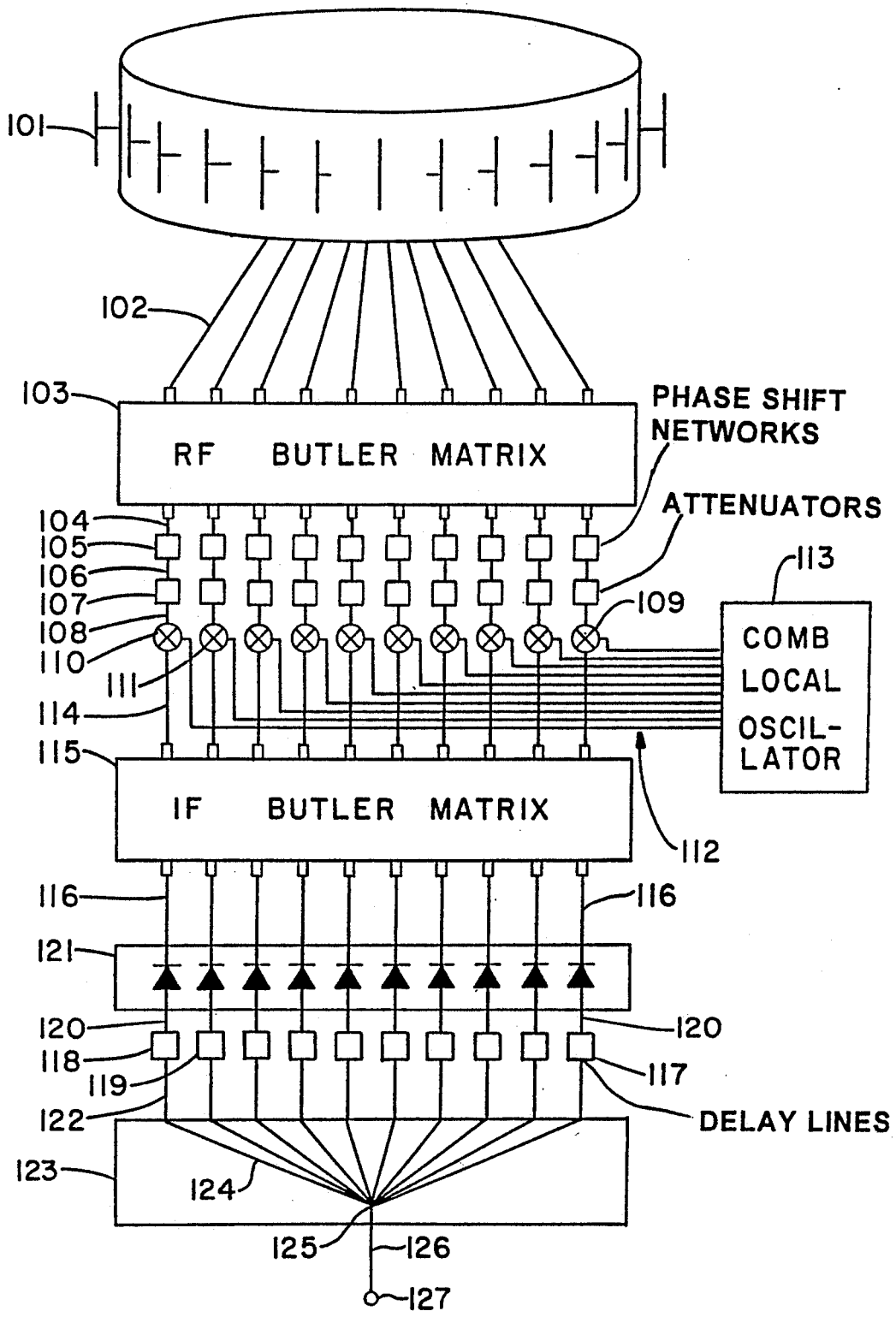
FIG. 2 is a block diagram that is a slight modification of FIG. 1.

With reference to FIG. 2 of the drawings, it should be understood that the same essence of the invention as described above with regard to FIG. 1 is employed except that the envelope detectors 121 are interchanged with the delay lines which are depicted by 117 being the far delay line to the right with 118 being the far delay line to the left and 119 being the delay line immediately adjacent to 118. It is understood, of course, that these delay lines are of progressively differing lengths from 117 across to 118. The modification of FIG. 2 thus has the delay lines accomplished at the video output from the envelope detectors which can reduce insertion loss and/or have a size advantage in the actual mechanism of FIG. 1. However, both techniques will accomplish the same end result at the single output port 127.

While in accordance with the patent statutes only the best mode and preferred embodiment of the invention has been illustrated and described in detail, it is to be understood that the invention is not limited thereto or thereby, but that the scope of the invention is defined by the appended claims.

What is claimed is:

1. An apparatus for eliminating the frequency selectivity and sampling loss of signal energy in cylindrical receiving antenna systems which scan a directive beam at a rate that is faster than the information rate being received, comprising:

(a) a cylindrical phased array antenna comprising a plurality of radiator elements evenly spaced around a circular arc;

(b) means for decomposing the distribution of current on the radiator elements caused by electromagnetic wave incidence into component signals which are the Fourier spatial harmonics of the distribution;

(c) means to differentially delay and phase shift said component signals to achieve a desired time invariant relative phasing of the signals for beam focusing;

(d) means to differentially weight the amplitude of said delayed and phase shifted component signals to achieve a desired time invariant relative weighting of the signals for beam shape control;

(e) means to differentially phase shift these weighted component signals at rates exceeding $4\pi$ radians per cycle of the highest frequency present in the information content of the incident electromagnetic wave to achieve beam scanning;

(f) means for forming a plurality of beams of sensitivity from said differentially phase shifted component signals from the means of step (e), said plurality of beams of sensitivity being equal in number to the number of antenna elements in said circular arc, the beams being contiguous and considered as lying in the azimuth plane for reference purposes, with each beam being generally evenly spaced from the adjacent beams;

(g) means for detecting modulation envelopes of said signals received by each beam of sensitivity;

(h) means to differentially delay signals received by each beam of sensitivity, said signals being input to or output from said means for detecting modulation envelopes; and (i) means for noncoherently combining said beam signals after said beam signals have been differentially delayed.

2. An apparatus as in claim 1, further comprising:

(a) said means for decomposing the distribution of current on the radiator elements, comprising a real-time discrete Fourier transformer having a number of input ports equal to the number of radiator elements and an equal number of output ports;

(b) means to differentially delay and phase shift said component signals comprising a plurality of networks each network consisting of a section which provides nondispersive delay and a section which provides differentially phase shift which is constant with frequency;

(c) said means to differentially weight the amplitude of said delayed and phase shifted component signals comprising a plurality of attenuators;

(d) said means for differentially phase shifting to achieve beam scanning comprising a number of heterodyne mixers equal to the number of output ports of the Fourier transformer and coupled to means for generating a number of local oscillator signals equal to the number of mixers, the frequency of each local oscillator signal being offset from that of the preceding one so that the frequency from the first to the last of the signals form a linear arithmetic progression with a common difference, the means for generating the local oscillator signals producing signals which are coherently related so that at the same point in each cycle of the common difference frequency, the sinusoidal variations of the local oscillator signals will simultaneously reach their peaks; and (e) said means for forming a plurality of beams comprising an intermediate frequency beam-forming network having a plurality of input ports equal to the number of mixers with each of said input ports being coupled to a separate output port of one of said mixers, and said intermediate beam-forming network having a plurality of output ports equal to the number of beams;

(f) said means for differentially delaying the signals received by each beam comprising a plurality of delay lines equal in number to the number of beams, each delay line being designated by the same number as the beam-forming network output port to which it is coupled, the delay of each delay line being offset from that of the preceding one in the order of its arithmetic designation to order the delays of the delay lines from the first to the last in a linear arithmetic progression with a common difference equal to the reciprocal of the product of the number of beams times the beam scanning rate;

(g) said means for detecting modulation envelopes comprising a plurality of envelope detectors, said envelope detectors being equal in number to the number of beams; and (h) said means for noncoherently combining a plurality of signals comprising a video frequency signal combiner having a single output port and a plurality of input ports equal in number to the number of output ports of said beam-forming network, with each input port of the signal combiner being coupled to an output port of said beam-forming network, said plurality of delay lines and said plurality of envelope detectors being disposed between said beam-forming network and said video frequency signal combiner.

3. An apparatus according to claim 2 wherein the real time discrete Fourier transformer is an RF Butler Matrix and the intermediate-frequency beam-forming network is an IF Butler Matrix.

4. A process for eliminating the frequency selectivity and sampling loss of signal energy is cylindrical receiving antenna systems which scan a directive beam at a rate that is faster than the information rate being received, comprising the steps of:

(a) providing a cylindrical phased array antenna comprising a plurality of radiator elements evenly spaced around a circular arc;

(b) providing means for decomposing the distribution of current on the radiator elements caused by electromagnetic wave incidence into component signals which are the Fourier spatial harmonics of the distribution;

(c) providing means to differentially delay and phase shift said component signals to achieve a desired time invariant relative phasing of the signals for beam focusing;

(d) providing means to differentially weight the amplitude of said delayed and phase shifted component signals to achieve a desired time invariant relative weighting of the signals for beam shape control;

(e) providing means to differentially phase shift these weighted component signals at rates exceeding $4\pi$ radians per cycle of the highest frequency present in the information content of the incident electromagnetic wave to achieve beam scanning;

(f) providing means for forming a plurality of beams of sensitivity from said differentially phase shifted component signals from the means in (e), said plurality of beams of sensitivity being equal in number to the number of antenna elements in said circular arc, the beams being contiguous and considered as lying in the azimuth plane for reference purposes, with each beam being generally evenly spaced from the adjacent beams;

(g) providing means for detecting modulation envelopes of said signals received by each beam of sensitivity;

(h) providing means for noncoherently combining said beam signals after said beam signals have been differentially delayed.

* * * * *